US009039550B1

(12) United States Patent
Broberg

(10) Patent No.: US 9,039,550 B1
(45) Date of Patent: May 26, 2015

(54) ARROW VANE

(71) Applicant: Du-Bro Products, Inc., Wauconda, IL (US)

(72) Inventor: James E. Broberg, Wauconda, IL (US)

(73) Assignee: Du-Bo Products, Inc., Wauconda, IL (US)

( * ) Notice: Subject to any disclaimer, the term of this patent is extended or adjusted under 35 U.S.C. 154(b) by 13 days.

(21) Appl. No.: 13/949,774

(22) Filed: Jul. 24, 2013

(51) Int. Cl.
*F42B 6/06* (2006.01)

(52) U.S. Cl.
CPC ..... *F42B 6/06* (2013.01)

(58) Field of Classification Search
USPC ..... 473/578, 585, 586
See application file for complete search history.

(56) References Cited

U.S. PATENT DOCUMENTS

| | | | | |
|---|---|---|---|---|
| 2,782,036 | A | 2/1957 | Folberth, Jr. et al. | |
| 3,667,758 | A | 6/1972 | Bengtsson | |
| 4,088,323 | A | 5/1978 | Munger | |
| 5,897,449 | A | 4/1999 | Roberts et al. | |
| 6,958,023 | B2 | 10/2005 | Simo et al. | |
| 7,914,406 | B2 | 3/2011 | Andrews | |
| 8,038,552 | B2 | 10/2011 | Song | |
| 8,105,189 | B1 | 1/2012 | Huang | |
| 2007/0173359 | A1 | 7/2007 | Mowery et al. | |
| 2009/0186723 | A1 * | 7/2009 | Andrews | 473/586 |
| 2013/0274041 | A1 * | 10/2013 | Griffith et al. | 473/586 |

* cited by examiner

*Primary Examiner* — John Ricci
(74) *Attorney, Agent, or Firm* — Mathew R.P. Perrone, Jr.

(57) ABSTRACT

Each vane for an arrow is both tapered or rounded at the leading edge, and shaped to provide better adherence to the arrow. With the injection molding of each vane, a proper, rounded, smooth shape is achieved. When combined with a bottom surface of the vane having indentations therein, good adherence of the vane to the shaft of the arrow is achieved.

4 Claims, 5 Drawing Sheets

Fig. 9
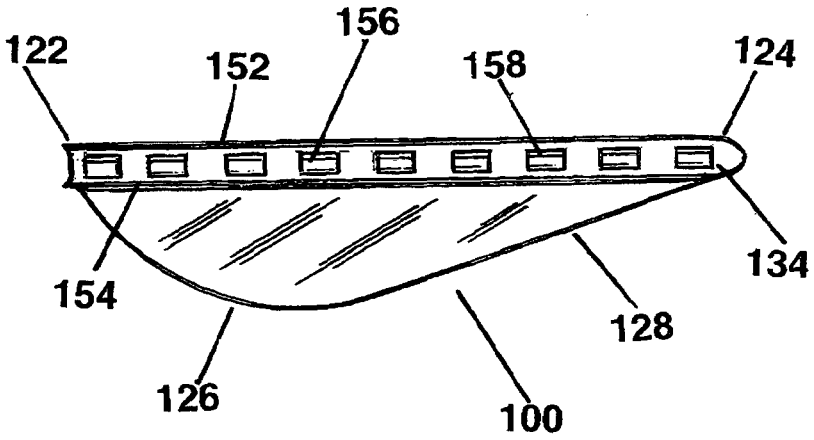
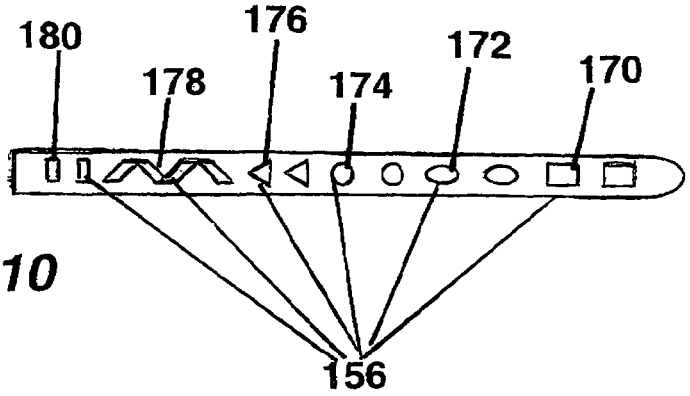
Fig. 10

ARROW VANE

This invention relates to an arrow vane for an arrow; and more particularly to an arrow vane for an arrow, the vane having a rounded front end, and with a mounting device to permit an adhesive to hold the vane more securely onto the arrow.

BACKGROUND OF THE INVENTION

In hunting or target shooting as an archer with a bow and arrow, three or four vanes on an arrow provide guidance for the arrow to its target at greater distances. An arrow is a rod or shaft of sufficient length with a nock end at one end thereof and an arrow head at the other end thereof. The nock fits on the bow string. The head strikes the desired target.

More particularly, the nock end is placed in contact with the string of the bow for the arrow to be used. The slot in the nock end receives the string. Adjacent to the nock end are two or more vanes, which provide the guidance for the arrow as it approaches the target. Typically, there are three or four vanes on the arrow. However, various other choices in the number vanes can be made.

The first arrows use feathers as vanes. The feathers can provide the guidance, without upsetting the balance of the arrow. Uniformity of the shaft, the arrow head and the vanes is critical to the balance of the arrow. However, it is difficult to provide uniform feathers to help the guidance of an arrow.

Modern arrows use synthetic materials such as aluminum, carbon fiber plastic or synthetic resins shaped as vanes or shafts. With the plastic vanes, there is difficulty in having the arrow achieve the desired accuracy. It is also difficult for the synthetic vane to adhere properly to the arrow. Also, it is difficult for the synthetic vanes to provide comparable guidance available from a feather based vane. Thus, adjustments to synthetic vanes, in order to make them more like feathers, are a prime interest to the modern archer.

Another problem with the vanes of the prior art is that each vane is die cut. Such processing leaves edges on the vane, which interferes with a good adherence of the vane to the shaft of the arrow. As the arrow is used, these edges catch on the target, which removes the vane from the shaft. With the vane gone, the arrow must be repaired or replaced. Yet, it is very difficult to achieve the desired adherence of the prior art vane to the shaft of the arrow.

If such vanes can provide the guidance of feathers, while maintaining durability and attachment to the arrow, great advantages are obtained. For example, the arrow can be reused many times, without the necessity of repair or replacement.

SUMMARY OF THE INVENTION

Among the many objectives of the present invention is the provision of a vane for an arrow to provide durability and guidance.

Another objective of the present invention is the provision of a vane for an arrow, which adheres well to the arrow.

Moreover an objective of the present invention is the provision of a vane for an arrow, which provides guidance for the arrow.

A further objective of the present invention is the provision of a vane, which is smooth to promote proper adherence.

A still further objective of the present invention is the provision of a vane for an arrow made of a synthetic material.

Yet a further objective of the present invention is the provision of a vane for an arrow, which passes through the air in a more streamlined fashion.

These and other objectives of the invention (which other objectives become clear by consideration of the specification, claims and drawings as a whole are met by providing a vane for an arrow which is both rounded away from the nock of the arrow, and shaped to provide better adherence to the arrow.

BRIEF DESCRIPTION OF THE DRAWINGS

FIG. 9 depicts bottom perspective view of a vane 100 of this invention.

FIG. 10 depicts a modified bottom plan view of a vane 100 of this invention.

Throughout the figures of the drawings, where the same part appears in more than one figure of the drawings, the same number is applied thereto.

DESCRIPTION OF THE PREFERRED EMBODIMENTS

Figure 1:
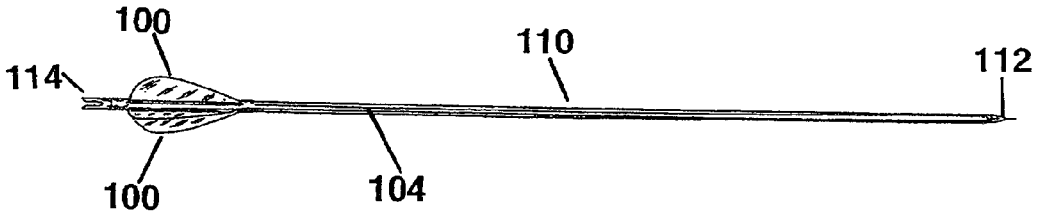
FIG. 1 depicts a perspective view of a vane 100 of this invention mounted on an arrow 104.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

The subject of the present invention solves the concerns set forth previously by providing a vane for an arrow which is both rounded adjacent to the arrowhead, and shaped to provide better adherence to the shaft of the arrow. A vane is also sometimes called a fletching. An arrow has a shaft, with a nock at one end to receive a bow string, and an arrowhead at the other end for striking the target. The vane has a shaft contact side which has at least one indentation therein, which facilitates and strengthens the attachment of the vane to the shaft adjacent to or near the nock. By injection molding of the vane, an appropriate rounding at the front of the vane being closer to the arrowhead than to the nock is achieved. The part of the vane closer to the nock lacks edges that can catch on the target and remove the vane from the shaft. The long axis of the shaft is substantially parallel to long axis of the vane, as the vane is mounted on the shaft.

Figure 2:
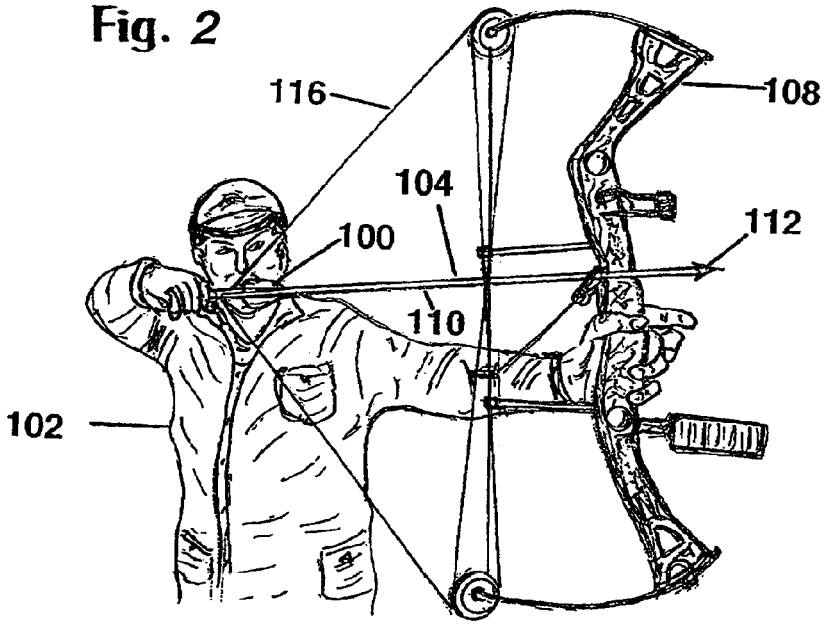
FIG. 2 depicts a perspective view of a vane 100 of this invention mounted on an arrow 104 in use.
Figure 3:
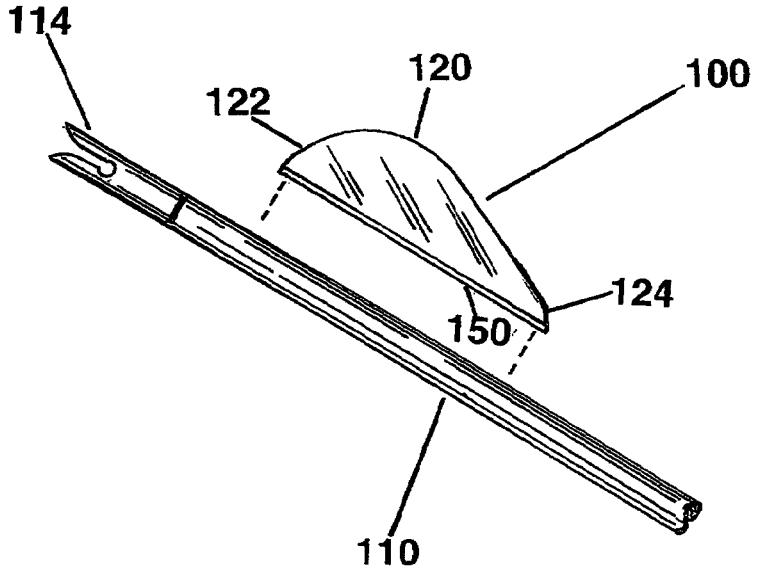
FIG. 3 depicts an exploded view of a vane 100 of this invention in relation to an arrow 104.

Referring to FIG. 1 and FIG. 2, vane 100 of this invention is part of an arrow 104 used by an archer 102 with a bow 108. Arrow 104 has a shaft 110, with an arrowhead 112 mounted at one end thereof. At the other end of the shaft 110 is a nock 114, which receives a string 116 of the bow 108. Adjacent to the nock 114 are a plurality of vanes 100 to provide guidance to the arrow 104, when the arrow 104 is shot from bow 108.

Adding FIG. 3, FIG. 4, FIG. 5, FIG. 6, FIG. 7, FIG. 8, and FIG. 9 to the consideration; the structure of vane 100 becomes more clear. Vane 100 has a topside 120 and a bottom side 150. The bottom side 150 is secured to the shaft 110. The topside 120 permits vane 100 to provide in-flight guidance to the arrow 104. Vane 100 has a nock end 122, and a head end 124 oppositely disposed therefrom as a part of vane 100.

From nock end 122, topside 120 of vane 100 has an upward arc 126, which extends into a triangulated line 128, and into a mounting site 134 at head end 124 on shaft 110. The topside 120 thus forms a top edge of the vane 120

Figure 4:
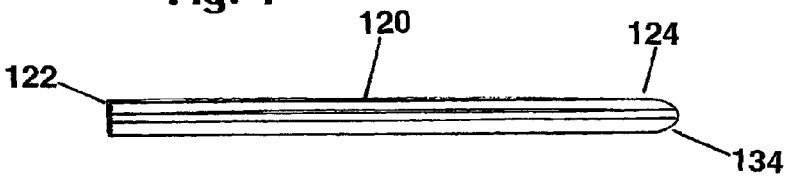
FIG. 4 depicts a top plan view of a vane 100 of this invention.
Figure 5:
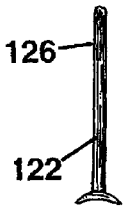
FIG. 5 depicts a rear plan view of a vane 100 of this invention.
Figure 6:
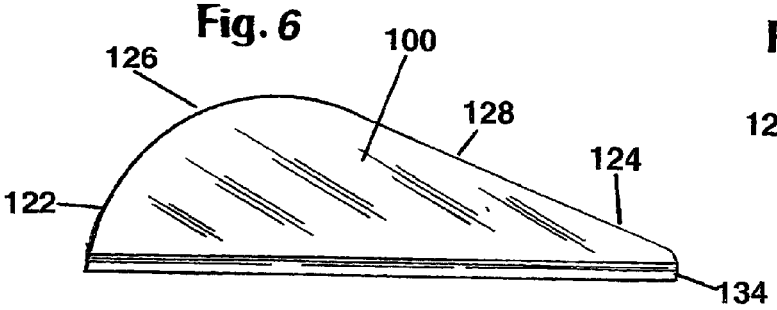
FIG. 6 depicts a side view of a vane 100 of this invention.
Figure 7:
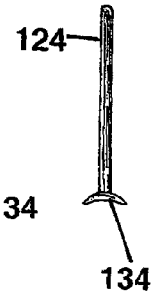
FIG. 7 depicts a front plan view of a vane 100 of this invention.

Vane 100 has a pair of oppositely disposed flange extensions. Flange extensions include a first flange 152 and a second flange 154 oppositely disposed from each other, and extending along the length of the vane 100, as seen in FIG. 4, FIG. 8 and FIG. 9.

From nock end 122, flange extensions 152 and 154 extend linearly towards head end 124, running parallel to topside 120. At head end 124, flange extensions 152 and 154 are rounded at mounting site 134. Rounding or tapering the flange extensions 152 and 154 provide a rounded mounting site 134, which has been shown to have advantageous attachment properties for vane 100 to.

A rounded mounting site 134 allows vane 100 to be attached to shaft 110 with increased stability and durability, as compared to traditional vanes having rectangular and untapered mounting sites. With the rounded mounting site 134, vane 100 will stay with the arrow 104 in flight and at the striking of the desired target or game.

Figure 8:
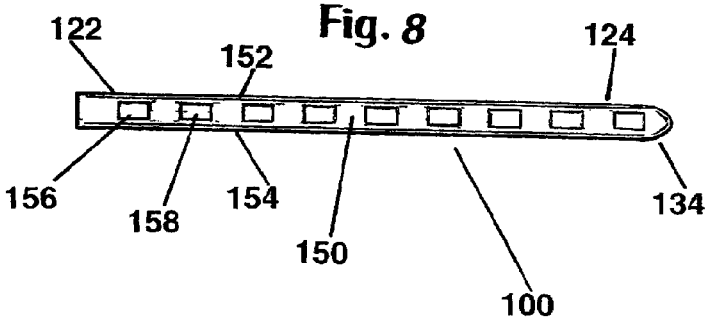
FIG. 8 depicts bottom plan view of a vane 100 of this invention.

Turning now to the bottom side 150, and FIG. 8 and FIG. 9 in particular, the mounting of vane 100 on shaft 110 becomes clear. At bottom side 150, vane 100 has a pair of oppositely disposed flange extensions. Flange extensions include first flange 152 and second flange 154 oppositely disposed from each other extending along the length of the bottom side 150. At head end 124, flange extensions 152 and 154 are rounded or tapered inward to mounting site 134.

Between the first flange 152 and a second flange 154, a series of glue pockets 156 provide rectangular indentations 158 in bottom side 150. Tests show that the plastic material for vane 100 with glue pockets 156 adhere more efficiently to shaft 110. So between the first flange 152 and the second flange 154, the glue pockets 156 permit the vane 100 to be efficiently adhered to the shaft 110 of the arrow 104.

With the addition of FIG. 10 the consideration, it becomes clear that glue pockets 156 may be rectangular 170, elliptical 172, circular 174, triangular 176, letter shaped 178, vertical rectangles 180, or any other suitable shape known to those with ordinary skill in the art.

Figure 11:
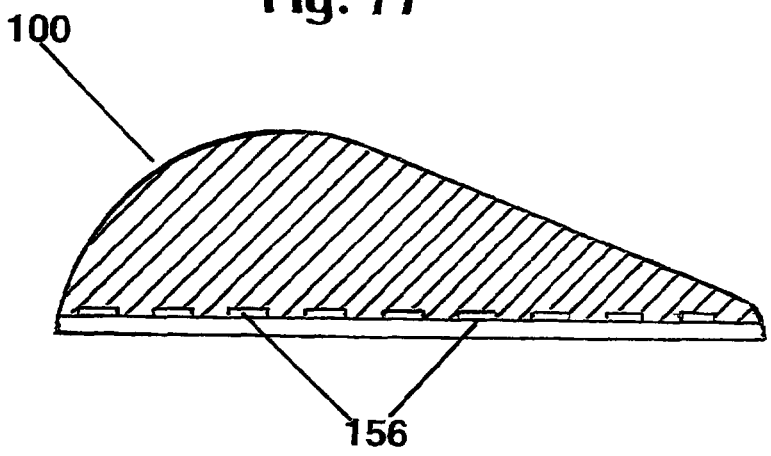
FIG. 11 depicts a cross-section of FIG. 7 taken along Line 11-11, of a vane 100 of this invention.
Figure 12:
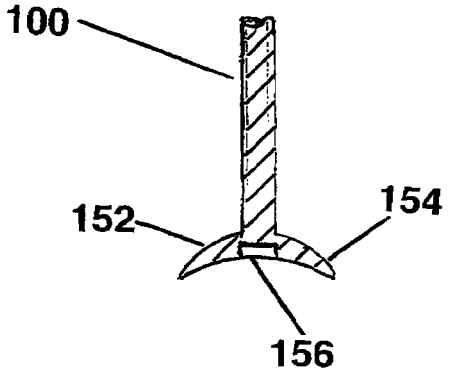
FIG. 12 depicts a cross-section of FIG. 6 taken along Line 12-12, of a vane 100 of this invention.

In FIG. 11 the shape or shapes of the glue pockets 156 become more clear. FIG. 12 also depicts the glue pockets 156 with a showing of the first flange 152 and a second flange 154.

The desired rounding or tapering of flange extensions 152 and 154 at mounting site 134, and the inclusion of glue pockets 156 on bottom side 150 of the vane 100, is preferably accomplished by injection molding of the plastic or other suitable material to form the vane 100. In this way, the vane 100 is smooth with the appropriate adherence support to shaft 110. This structure for vane 100 is believed to provide better adherence to the arrow 104.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A vane for an arrow comprising:

the vane having a forward end and a rearward end;

the vane being rounded at the forward end of the vane;

the vane being shaped to provide better adherence to the arrow;

the arrow having a shaft, with a nock at one end of the shaft to receive a bow string, and an arrowhead at an opposing end of the shaft for striking a target;

the vane having a shaft contact side to be adhered to the shaft;

the shaft contact side having at least one indentation therein, which facilitates and strengthens an attachment of the vane to the shaft;

the attachment of the vane being adjacent to or near the nock and along an axis of the shaft;

the vane having a topside and a bottom side oppositely disposed from the topside;

the bottom side being securable to the shaft;

the bottom side including at least one indentation to facilitate securing the vane to the shaft;

the vane having a nock end and a head end oppositely disposed from the nock end;

the nock end of the vane being close to the nock when mounted on the shaft;

the head end of the vane being close to the arrowhead when mounted on the shaft;

the topside of the vane having an upward arc which extends from the nock end into a triangulated line;

the triangulated line extending downwardly into a mounting site at the head end;

the mounting site being rounded to facilitate adherence of the vane to the shaft;

the bottom side of the vane having a first flange and a second flange oppositely dosed from the first flange;

the first flange and the second flange extending along the length of the vane;

the first flange and the second flange being at the rounded mounting site;

the rounded mounting site allowing the vane to be attached to the shaft with increased stability and durability;

the first flange and the second flange including a series of glue pockets therebetween; and the glue pockets being indentations to facilitate glue holding of the vane to the shaft.

2. The vane of claim 1 further comprising the glue pockets having at least one shape selected from the group consisting of rectangular, elliptical, circular, triangular, letter shaped, or a vertical rectangle.

3. In an arrow for use with a bow in archery, the arrow having a shaft, with an arrowhead mounted at one end of the shaft and a nock at the other end of the shaft to receive a string of the bow, with a plurality of vanes being secured to the shaft adjacent to the nock, the improvement comprising:

the vane having a forward end and a rearward end;

the vane being rounded at the forward end of the vane;

the vane being shaped to provide better adherence to the arrow;

the vane having a shaft contact side to be adhered to the shaft;

the shaft contact side having at least one indentation therein, which facilitates and strengthens an attachment of the vane to the shaft;

the attachment of the vane being adjacent to or near the neck and along an axis of the shaft;

the vane having a topside and a bottom side oppositely disposed from the topside;

the bottom side being securable to the shaft;

the bottom side including at least one indentation to facilitate securing the vane to the shaft;

the vane having a neck end and a head end oppositely disposed from the nock end;

the nock end of the vane being close to the nock when mounted on the shaft;

the head end of the vane being close to the arrowhead when mounted on the shaft;

the topside of the vane having an upward arc which extends from the nock end into a triangulated line;

the triangulated line extending downwardly into a mounting site at the head end;

the mounting site being rounded to facilitate adherence of the vane to the shaft;

the bottom side of the vane having a first flange and a second flange oppositely disposed from the first flange;

the first flange and the second flange extending along the length of the vane;

the first flange and the second flange being at the rounded mounting site;

the rounded mounting site lowing the vane to be attached to the shaft with increased stability and durability;

the first flange and the second flange including a series of glue pockets therebetween; and the glue pockets being indentations to facilitate glue holding of the vane to the shaft.

4. The arrow of claim 3 further comprising the glue pockets having at least one shape selected from the group consisting of rectangular, elliptical, circular, triangular, letter shaped, or a vertical rectangle.

* * * * *